US009557089B2

(12) United States Patent
Visin

(10) Patent No.: US 9,557,089 B2
(45) Date of Patent: Jan. 31, 2017

(54) STIR STICK AND BREAKER WALLS FOR AN ICE CONTAINER

(71) Applicant: Whirlpool Corporation, Benton Harbor, MI (US)

(72) Inventor: Jerold M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 429 days.

(21) Appl. No.: 14/012,099

(22) Filed: Aug. 28, 2013

(65) Prior Publication Data

US 2015/0059366 A1 Mar. 5, 2015

(51) Int. Cl.
*F25C 5/18* (2006.01)

(52) U.S. Cl.
CPC ..... *F25C 5/182* (2013.01); *F25C 2500/08* (2013.01)

(58) Field of Classification Search
CPC ..... F25C 5/182; F25C 2500/08; F25C 5/007; F25C 2400/04; F25C 5/18
USPC ..... 62/344, 66; 222/232–235
See application file for complete search history.

(56) References Cited

U.S. PATENT DOCUMENTS 2,611,513 A * 9/1952 Kilpatrick ..... B65D 88/64 222/235
3,067,591 A * 12/1962 Lingle ..... F25C 5/002 222/239
3,200,600 A * 8/1965 Elfving ..... F25B 21/04 62/3.63
3,217,940 A * 11/1965 Fahn ..... A47F 1/03 222/183
3,272,397 A * 9/1966 Bean ..... A01C 15/16 222/189.05
3,276,224 A * 10/1966 Lunde ..... 222/245
3,393,839 A * 7/1968 Weil ..... A47G 19/32 222/239
3,651,656 A * 3/1972 Esser ..... F25C 5/182 62/137
3,747,810 A * 7/1973 Graser ..... B65D 88/66 222/199
3,887,119 A * 6/1975 Sucro ..... F25C 5/00 222/247
3,968,906 A * 7/1976 Kochendorfer ..... F25C 5/00 222/243
4,228,934 A * 10/1980 Carr ..... F25C 5/002 222/240

(Continued)

FOREIGN PATENT DOCUMENTS

JP 2004301486 A 10/2004
KR EP 2886979 A2 * 6/2015 ..... F25D 23/028

*Primary Examiner* — Len Tran
*Assistant Examiner* — Kirstin Oswald

(57) ABSTRACT

A refrigerator is provided comprising a cabinet, a door for providing access within the cabinet, an ice maker for making ice operably connected to the cabinet, an ice bin comprising a pair of opposite-facing walls and a bottom wall, disposed within the cabinet and located adjacent the ice maker, and a stir assembly positioned within the ice bin, comprising a stir stick, a cam rod, and a pair of breaker walls; wherein the stir stick is configured to oscillate about an axis of rotation, the cam rod is coupled to the stir stick; and the pair of breaker walls are engaged with the cam rod near the bottom of the breaker walls, and hingedly attached to the pair of opposite-facing walls.

20 Claims, 4 Drawing Sheets

(56) References Cited

U.S. PATENT DOCUMENTS 4,287,725 A * 9/1981 Hoenisch ..... F25C 5/002 406/135
4,324,494 A * 4/1982 Pryor ..... A47J 31/401 222/129.3
4,329,792 A * 5/1982 Berner ..... E01H 5/04 37/246
4,632,280 A * 12/1986 Mawby ..... B65G 65/44 222/243
4,676,405 A * 6/1987 Lents ..... F25C 5/007 222/108
5,088,300 A * 2/1992 Wessa ..... F25C 5/18 62/340
6,039,220 A * 3/2000 Jablonski ..... G01F 13/005 222/146.6
6,050,097 A * 4/2000 Nelson ..... F25C 5/005 62/137
6,082,130 A 7/2000 Pastryk et al.
6,425,259 B2 7/2002 Nelson et al.
6,612,733 B2 * 9/2003 Schmidt ..... B01F 7/00208 366/292
6,758,047 B1 * 7/2004 Giles ..... F25C 5/007 222/146.6
7,111,473 B2 9/2006 Chung et al.
7,422,168 B2 9/2008 Jung et al.
7,631,513 B2 12/2009 Chung et al.
7,739,879 B2 6/2010 Sellers et al.
7,818,975 B2 10/2010 Chung et al.
7,841,204 B2 * 11/2010 Kim ..... F25C 5/005 222/413
7,963,120 B2 6/2011 An et al.
8,011,202 B2 * 9/2011 Kim ..... F25C 5/005 62/344
8,353,146 B1 * 1/2013 Bareford ..... B65B 25/00 53/127
8,899,064 B2 * 12/2014 Hwang ..... F25C 5/005 62/320
2004/0163405 A1 * 8/2004 Jung ..... F25C 5/005 62/344
2004/0261442 A1 * 12/2004 Chung ..... F25C 5/007 62/344
2006/0059939 A1 * 3/2006 An ..... F25C 5/046 62/344
2006/0196213 A1 * 9/2006 Anderson ..... F25C 5/005 62/344
2006/0202071 A1 * 9/2006 Jung ..... F25C 5/005 241/34
2006/0202072 A1 * 9/2006 Lee ..... F25C 5/007 241/101.2
2008/0156023 A1 * 7/2008 Kim ..... F25C 5/005 62/344
2008/0283145 A1 * 11/2008 Maxwell ..... B65B 5/067 141/114
2008/0295538 A1 * 12/2008 Kim ..... F25C 5/007 62/354
2009/0133428 A1 * 5/2009 An ..... F25C 5/005 62/320
2009/0145157 A1 6/2009 Jeong et al.
2009/0205358 A1 * 8/2009 Smtih ..... F25C 5/005 62/457.1
2009/0211292 A1 * 8/2009 Smith ..... F25C 5/187 62/344
2009/0314016 A1 12/2009 Ashrafzadeh et al.
2010/0077774 A1 * 4/2010 Takagi ..... F25C 1/12 62/66
2010/0313593 A1 * 12/2010 Lee ..... F25C 5/005 62/320
2011/0048052 A1 * 3/2011 Lee ..... F25C 5/007 62/320
2011/0067429 A1 * 3/2011 Lee ..... F25C 5/005 62/344
2011/0120152 A1 5/2011 Talegaonkar
2011/0283732 A1 11/2011 Shin et al.
2011/0308269 A1 12/2011 Mitchell
2012/0036881 A1 2/2012 Lawson
2012/0096891 A1 * 4/2012 Mitchell ..... F25C 5/005 62/347
2013/0042644 A1 * 2/2013 Mitchell ..... F25C 5/002 62/320

* cited by examiner

STIR STICK AND BREAKER WALLS FOR AN ICE CONTAINER

BACKGROUND OF THE DISCLOSURE

Ice makers may be included with refrigerators, or may be stand-alone units. In general, the ice maker includes a water source, a cooling source, a mold, and an ejecting mechanism. Water is added to the mold, and the cooling source removes heat from the water to lower the temperature below freezing, at which time ice cubes are formed. Once the cubes have formed, the ejecting mechanism operates to remove or eject the formed cubes from the molds, at which point new water can be added and the process repeated.

The ejected ice cubes are generally directed towards an ice container or ice storage bin. In refrigerators and in stand-alone units, the ice container is located generally adjacent the ice maker so that the formed ice cubes do not have to travel a long distance from the ice maker. Furthermore, the cooled air of the cooling source may be used to direct cold air to the ice container to keep the ice cubes in the ice container below freezing to prevent the cubes from melting.

In a refrigerator, the ice maker and ice container may be positioned on the inside of a refrigerator compartment or freezer compartment door, with the ice maker generally positioned above the ice container such that gravity causes the formed ice cubes to fall from the ice maker to the ice container. The cooling source in a refrigerator may be cold air that is directed from the freezer compartment to the ice maker. The cooling source may also be any other cooling source known to those skilled in the art such as additional evaporators. The below-freezing air from the freezer removes enough heat to freeze the water in the ice molds. The same air may also be passed into the ice container to prevent the cubes from melting.

However, as the amount of cubes accumulate in the ice container, it becomes more difficult to ensure that all of the cubes are at a temperature to prevent melting. If air is passed into the container, it may not reach cubes that are located below other cubes. Warm air may also be introduced to the ice container if a door is opened or the ice container is opened to retrieve ice from the container. In any sense, the cubes in the container may experience some melting and refreezing. The melting and refreezing of the cubes can cause multiple cubes to freeze together, forming ice clumps. Sublimation may also lead to ice cubes clumping. The ice clumps are too large to fit through a dispenser opening, and therefore, it is important to provide means to prevent clumping, or to break up the clumps.

Stir sticks have been added to ice containers to aid in preventing and breaking up ice clumps. The stir sticks are configured to rotate within an ice container to move the cubes and to direct the cubes towards a dispensing area. However, the size and shape of ice containers do not make it feasible for the stir sticks to reach the full area within the containers. Therefore, there are areas within the container that still include conditions that allow the formation of ice clumps.

SUMMARY OF THE PRESENT DISCLOSURE

One object, feature and/or advantage of the present disclosure includes an apparatus and method of preventing the formation of ice clumps in an ice container.

Another object, feature and/or advantage of the present disclosure includes an apparatus and method for breaking up clumps of ice that have formed in an ice container.

These and other aspects, objects, and features of the present disclosure will be understood and appreciated by those skilled in the art upon studying the following specification, claims, and appended drawings. The present disclosure is not to be limited to or by these objects, features, and advantages. No single embodiment need provide each and every object, feature, or advantage.

According to one aspect of the present disclosure includes an apparatus that includes a stir stick providing cam action to a cam rod, which in turn provides rocking action to a pair of breaker walls.

Still another aspect of the present disclosure provides a method for driving a combination of a bent stir stick and a pair of breaker walls to provide mechanical action to break up ice clumps that have formed in an ice container.

These and other aspects, objects, and features of the present disclosure will be understood and appreciated by those skilled in the art upon studying the following specification, claims, and appended drawings. The present disclosure is not to be limited to or by these objects, features, and advantages. No single embodiment need provide each and every object, feature, or advantage.

DETAILED DESCRIPTION OF EMBODIMENTS

Figure 1:
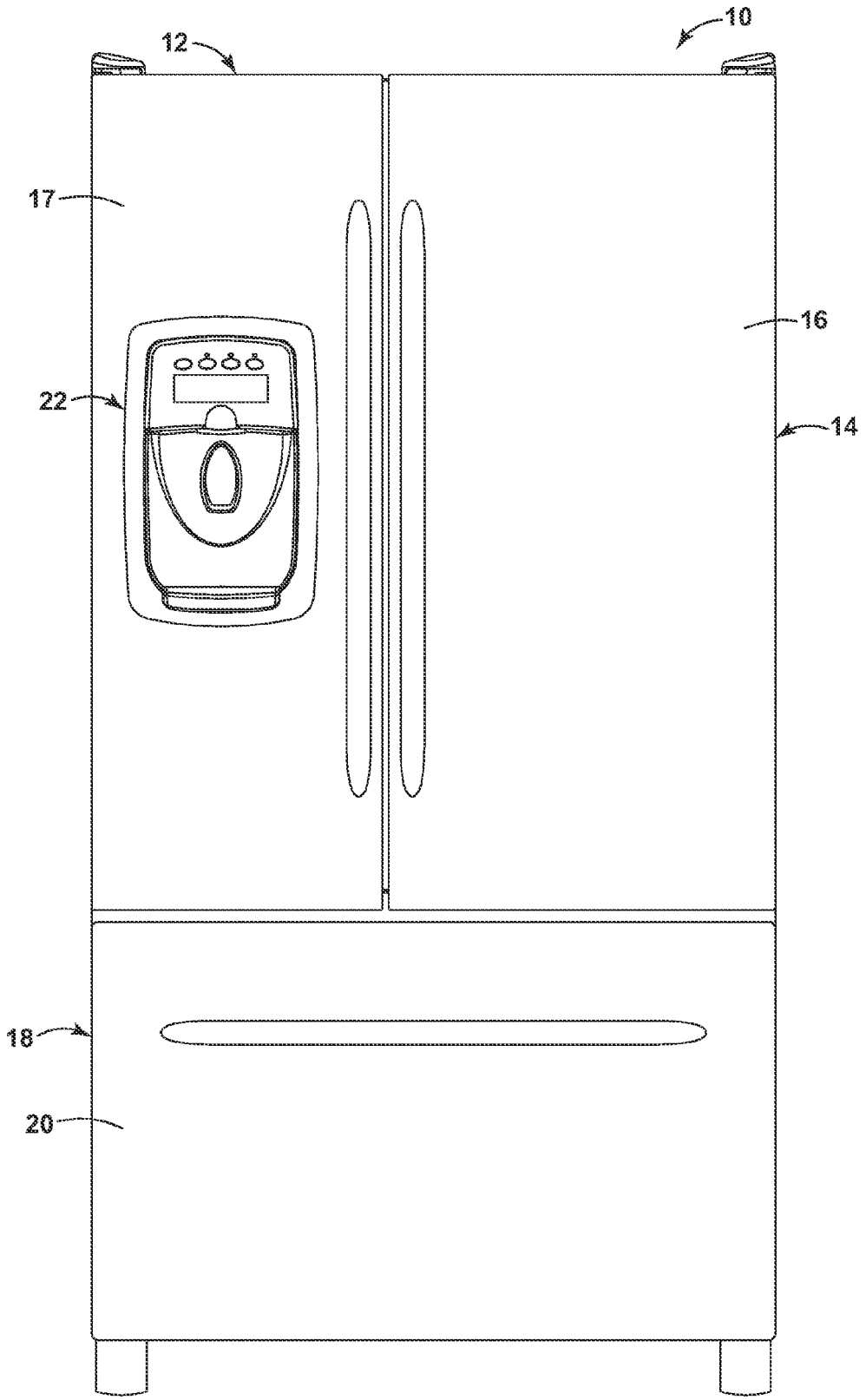
FIG. 1 is a front elevation view of a bottom mount refrigerator.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used in this disclosure, the term "cam action" is defined as all of the parts necessarily included in a system that changes a rotational movement input into an output of linear translational movement.

Referring FIG. 1 is a front elevation view of a bottom mount refrigerator 10. The bottom mount refrigerator 10 includes a cabinet 12 encapsulating the compartments of the refrigerator 10. As shown in FIG. 1, the upper compartment is a refrigerator or fresh food compartment 14. First and second doors 16, 17 provide access to the interior of the refrigerator compartment 16. A dispenser 22 is positioned on one of the doors 17 of the refrigerator compartment 16. The dispenser 22 may be a water dispenser, ice dispenser, other beverage dispenser, or some combination thereof. Furthermore, the dispenser 22 may be placed on any door 16, 17, 20 of the refrigerator 10, or the dispenser 22 may be placed within one of the compartments of the refrigerator 10. For example, the dispenser 22 may be placed at one of the interior walls of the refrigerator compartment 16, thus being part of the cabinet 12. The placement of the dispenser 22 is not to limit the present disclosure. Positioned generally below the refrigerator compartments 14 is a freezer compartment 18. A freezer door 20 provides access to the freezer compartment 18. The freezer door 20 of FIG. 1 is shown as a drawer-type door. However, the present disclosure contemplates that the freezer door 20 may be a drawer or hinge door for providing access to the interior of the freezer compartment 18.

Figure 2:
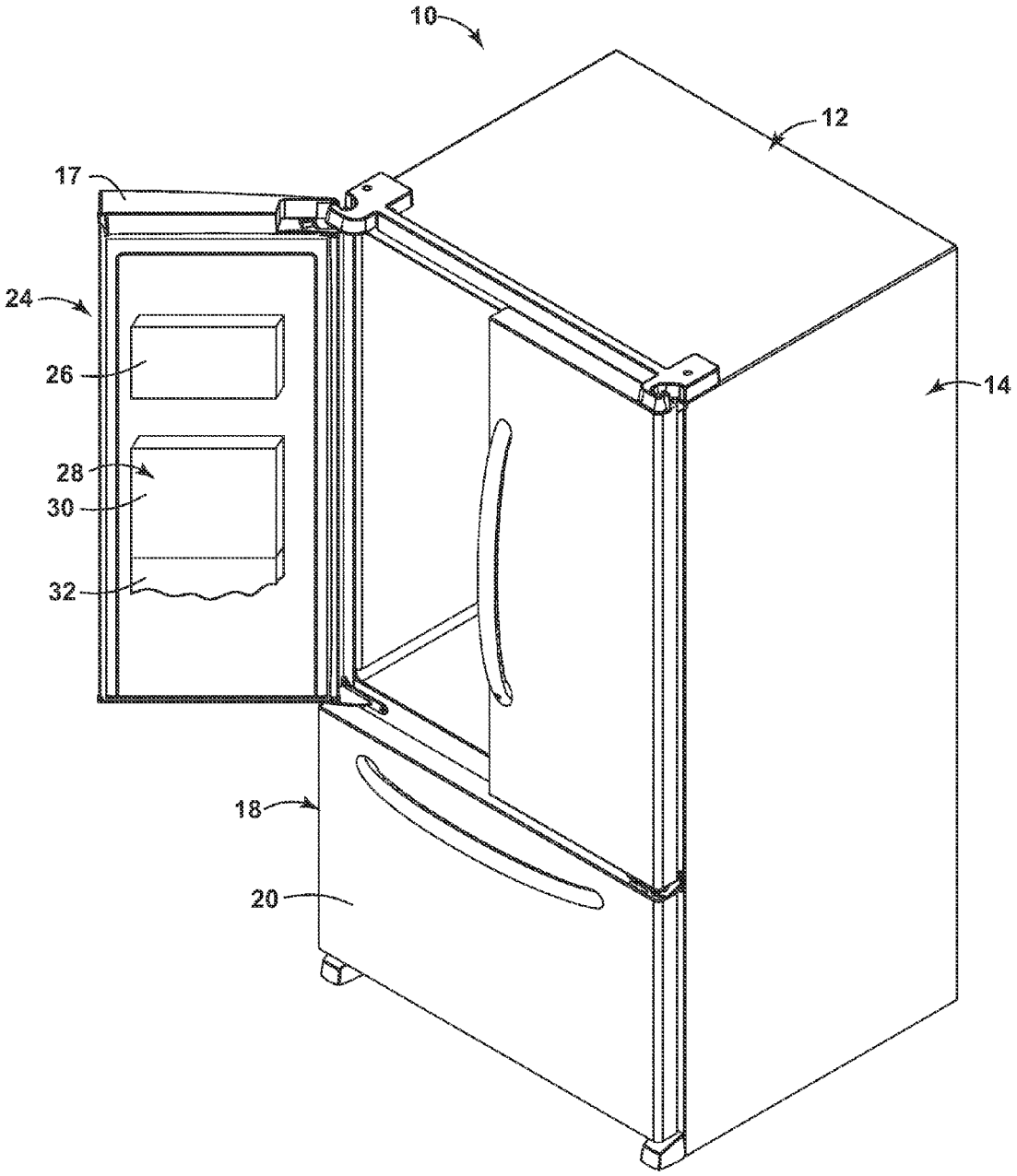
FIG. 2 is a perspective view of the refrigerator of FIG. 1 with the refrigerator doors open and showing an ice maker and ice container.

It should also be appreciated, that while FIGS. 1 and 2 show a bottom mount style refrigerator 10, the present disclosure contemplates that any style of refrigerator be included as part of the disclosure. The figures merely depict one example of a type of refrigerator that can be used with the present disclosure.

FIG. 2 is a perspective view of the bottom mount refrigerator 10 of FIG. 1 having the refrigerator door 17 opened and the refrigerator door 16 removed to show an interior of the refrigerator 10. In addition, the freezer door 20 is shown to be a drawer that can be slid open to provide access to the freezer compartment 18. FIG. 2 shows an ice making system 24, which is operably connected to a dispenser 22 of the refrigerator 10. As shown in FIG. 2, the ice making system 24 is positioned on the inside of the refrigerator door 17. However, as mentioned above regarding the dispenser 22, the ice making system 24 can be positioned generally anywhere with respect to the refrigerator 10. For example, the ice making system can be positioned in or at an upper portion of the refrigerator compartment 14, on a side wall of the refrigerator compartment 14, or even possibly in the freezer compartment 18. The location of the ice making system 24 is not to be limiting to the present disclosure.

The ice making system 24 shown in FIG. 2 includes an ice maker 26 and an ice container 28. The ice maker 26 can be any style or configuration of ice maker that produces ice cubes (not shown). The ice container 28 is operably connected to the ice maker 26 such that ice cubes made in the ice maker 26 are dispensed or directed into the ice container 28. The size of the ice container 28 should be sufficient enough to contain or hold an amount of ice sufficient for a user or owner. Furthermore, it should be contemplated that both the ice maker 26 and the ice container 28 may be removed from the refrigerator 10. Thus, the present disclosure contemplates that the ice making system 24 be a modular ice making system. Furthermore, it should be appreciated that only the ice container 28 may be removable from the refrigerator 10. Also shown in FIG. 2, the ice container 28 generally includes an upper portion 30 and a lower portion 32. The portions will be discussed in greater detail below. However, the upper and lower portions 30, 32 of the ice container 28 generally are constructed such that they comprise a single unit, and are not removed separately when the ice container is removed from the refrigerator 10.

Figure 3:
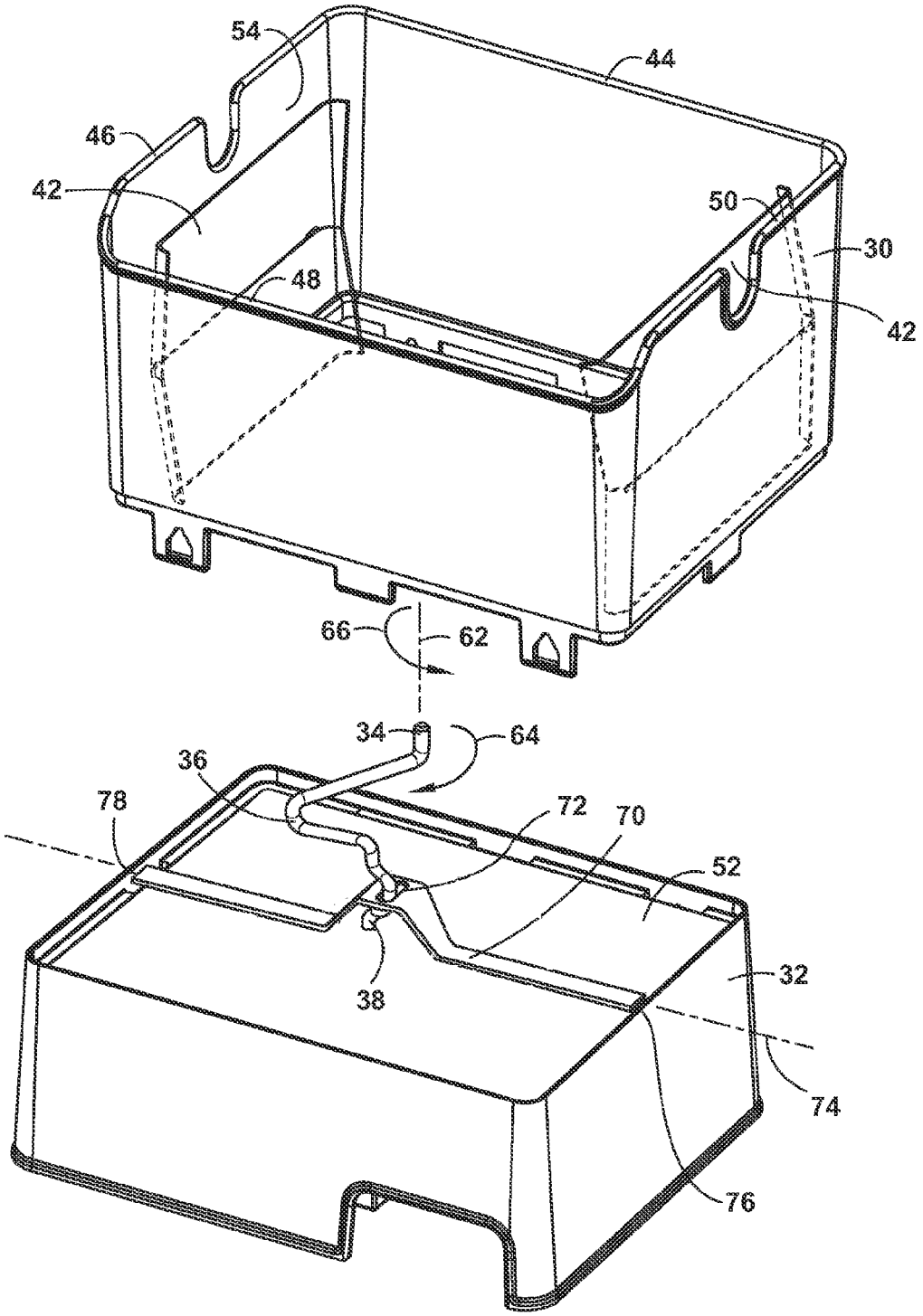
FIG. 3 is a partial exploded view of an ice container according to the present disclosure.

FIG. 3 is a partial exploded view of an ice container 28 according to the present disclosure. As shown in FIG. 3, the ice container 28 is generally a rectangular-shaped container. The rectangular shape of the ice container 28 of the present disclosure allows for a slimmer ice container 28 that will take up less useable space within the refrigerator 10. However, the present disclosure contemplates that the ice container 28 comprises generally any shape, including but not limited to oval shapes or any other geometrical shape that may allow for the ice container to hold a predetermined amount of ice, while taking up the least amount of space as possible within the refrigerator. In addition, the shape of the lower or bottom portion 32 of the ice container 28 may be the same or different than the shape of the upper portion 30 of the ice container 28. However, the upper and lower portions 30, 32 should be connectable in some manner.

Positioned within the ice container and generally near the center of the ice container is a stir stick 34. The stir stick is a rod-shaped member that can be rotated to move or displace the ice within the ice container 28. The movement of the ice cubes in the ice container 28 aids in preventing the ice cubes from melting or clumping, while also providing or aiding movement of the cubes towards an aperture 42 in the container 28 that dispenses the ice cubes from the ice container into a cup or other container. The stir stick 34 includes one or more bent portions 36 along the length of the stir stick. The bent portion provides greater area of the stir stick 34 as it rotates in the ice container 28. Furthermore, the stir stick 34 includes a generally vertical portion at the bottom 38 of the stir stick for extending into the bottom portion 32 of the ice container 28 and connecting to a motor 56. The motor may be any type of motor that can attach to the stir stick to provide rotation of the stir stick within the ice container 28.

The upper portion 30 of the ice container 28, as shown in FIG. 3, includes a first wall 44, second wall 46, third wall 48, fourth wall 50, and a bottom floor or wall 52, with corners 54 formed at the intersections of the walls. There may be breaker walls 42 attached to the first wall 44 and the third wall 48. The breaker walls 42 may be attached such that they hinge at or near the midpoint of the breaker walls 42 and near the midpoint of the first wall 44 and the third wall 48. The attachment one of the breaker walls 42 and the first wall 44 may be any attachment that would allow for a hinge action between the breaker wall 42 and the first wall 44, including but limited to a snap fit or a pin attachment. The attachment of another of the breaker walls 42 with the third wall 48 may be accomplished in the same way.

The bottom wall 52 may actually be part of the bottom or lower member 32 of the ice container 28. The bottom wall 52 includes the aperture 42 for dispensing the ice, and therefore, may include a crusher or crushing mechanism 40 positioned therein. As noted above, the bottom 38 of the stir stick 34 may extend through the aperture 42 as well to connect to the motor or other rotating means. While the stir stick is shown to be positioned generally in the center of the bottom wall 52, it should be appreciated that the stir stick can be positioned anywhere in the bottom wall to provide for the greatest amount of reach of the bent portions 36 of the stir stick 34.

While the stir stick 34 is configured to rotate, rotation alone may not allow for the bent portions 36 of the stir stick 34 to reach into the corners 54 of the ice container 28. Therefore, the ice at this location may begin to melt and/or clump together. Thus, the present disclosure contemplates that the stir stick 34 may be coupled with a cam rod 70. The cam rod 70 may have a slot 72 such that as the stir stick is rotated, the cam rod remains in the center of ice bin along an axis of translation 74. The stir stick 34 may be allowed to move within the slot 72 in a direction normal to the axis 74, but the rotational movement in the direction along the axis 74 translates the cam rod 70 along the axis 74, creating a cam action between the stir stick 34 and the cam rod 70.

Figure 4:
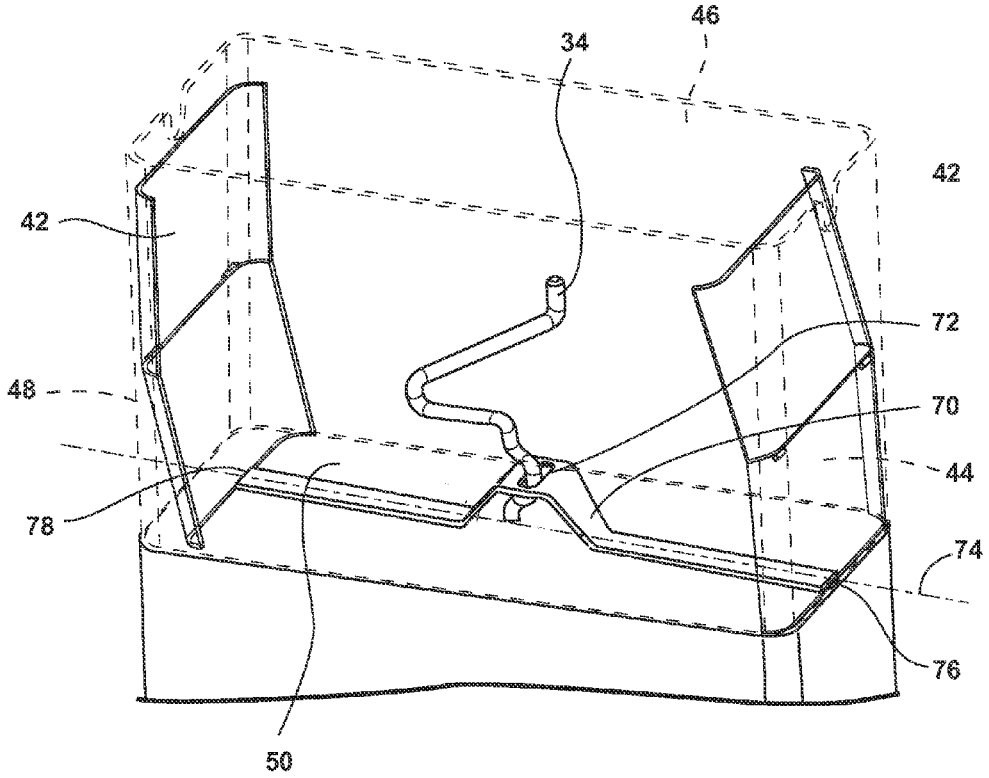
FIG. 4 is a perspective isometric view of the ice container according to the present disclosure.

Looking now at FIG. 4, the cam rod 70 has two ends 76 and 78. The ends 76 and 78 may be coupled with the breaker walls 42 near the bottom of the breaker walls 42, but in any case at some distance from the attachment of the breaker walls 42 to the first wall 44 and the third wall 48. The linear movement of the cam rod 70 when coupled with the breaker walls 42 at a distance from the attachment to the walls 44 and 48, may induce a rocking motion of the breaker walls 42. The rocking motion of the breaker walls 42 may allow for disturbance of the ice in edges and corners of the ice container 28 that simple rotation of the stir stick 34 may not be able to.

The cam rod 70 and the breaker walls 42 may be coupled in any fashion to allow for movement in two directions. This may be a snap on the ends 76 and 78 with a corresponding receiver portion on the breaker walls. It may also include a snap on the breaker walls 42 with a corresponding receiver portion on the ends 76 and 78. There may also be springs (not shown) between the walls 44 and 48 and the breaker walls 42 that bias the breaker walls toward the center of the ice container 28. The cam rod 70 may simply push on the breaker walls 42 against the springs, and the spring action returns the breaker walls 42 to their biased position. There may be dimples (not shown) on the ends 76 and 78 that interact with the breaker walls 42 such that the cam rod 70 is inserted through a hole in the breaker walls 42 into a position where there is one or more dimples on either side of the breaker walls 42 that provide the impetus for the movement of the breaker walls 42. Or there could be any other configuration known to a person having skill in the art to couple the cam rod 70 and the breaker walls 42 to allow for the movement described.

To break ice clumps and to prevent freeze up of ice in the ice container 28, the location of the ice container 28 and ice making system 24 should be determined. Thus, the location of the ice making system 24 may determine the shape of the ice container 28. As noted above, the shape of the ice container shall be such that the least amount of useable space within the refrigerator 10 is used by the ice container. Once the shape of the ice container 28, and more particularly the upper portion 30 of the ice container 28, has been determined, the shape 34 of the stir stick should be determined. The shape of the stir stick 34 will be determined on the shape of the ice container, such that the bends 36 of the stir stick 34 shall reach as great amount of area within the ice container as possible. The shape of the bend in the stir stick that provides the cam action to the cam rod 70 should then be calculated to allow for enough movement of the breaker walls 42. Once these factors have been determined, the ice container can be assembled.

Other variations of the above disclosure may be utilized as well. For instance, there may be no stir stick. In this case, the cam rod may be driven directly by a motor, or one or more motors may drive the walls directly. There also may be breaker walls on all four walls of the ice bin. In this case there may be two cam rods that drive the two pairs of breaker walls.

The foregoing description has been presented for purposes of illustration and description, and is not intended to be an exhaustive list or to limit the disclosure to the precise forms disclosed. It is contemplated that other alternative processes obvious to those skilled in the art are considered to be included in the disclosure. The description is merely examples of embodiments. For example, the shape of the stir stick 34 may be varied depending on the shape of the ice container. Furthermore, the location of the motor, stir stick, apertures, cam rod, breaker walls and the like may also be varied according to the size and shape of the ice container. It should be appreciated that the configuration of the stir stick, cam rod, breaker walls, and motor within the ice container as described above are but one possible configuration for providing oscillation, gyration, and rotation of the stir stick within the ice container. It is understood that many other modifications, substitutions, and/or additions may be made, which are within the intended spirit and scope of the disclosure. From the foregoing, it can be seen that the present disclosure accomplishes at least all of the stated objections.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A refrigerator, comprising:

a cabinet;

a door for providing access within the cabinet;

an ice maker for making ice operably connected to the cabinet;

an ice container comprising a pair of opposite-facing walls and a bottom wall having a center portion, disposed within the cabinet and located adjacent the ice maker; and a stir assembly comprising a stir stick, a cam rod, and breaker walls and positioned within the ice container; wherein the stir stick is configured to oscillate about an axis of rotation, the cam rod is coupled to the stir stick; and the pair of breaker walls are engaged with the cam rod near the bottom of the breaker walls, and hingedly attached to the pair of opposite-facing walls and move between a first position and second position in relation to the oscillating rotation of the stir stick.

2. The refrigerator of claim 1 further comprising a motor positioned under the bottom wall of the ice container.

3. The refrigerator of claim 2 wherein the stir stick is operably connected to the motor such that the motor rotates and oscillates the stir stick.

4. The refrigerator of claim 3, wherein the stir stick comprises a rod.

5. The refrigerator of claim 4, wherein the rod is bent along its length to protrude outwardly from the axis of rotation of the rod.

6. The refrigerator of claim 4, wherein the stir stick is positioned at the center portion of the bottom wall.

7. The refrigerator of claim 6, wherein the stir stick and cam rod are configured to accept a rotational motion input from the motor and deliver a linear motion output.

8. The refrigerator of claim 1 wherein the ice container is rectangular-shaped.

9. The refrigerator of claim 1 wherein the stir stick includes a bottom portion at a bottom wall of the ice container.

10. The refrigerator of claim 9 wherein the stir stick rotates about the bottom portion of the stir stick.

11. The refrigerator of claim 10 wherein the bottom portion of the stir stick extends through an aperture in the bottom wall of the ice container.

12. The ice container of claim 1, wherein the breaker walls are attached to the pair of opposite-facing walls at a midpoint of the breaker walls.

13. The ice container of claim 1, wherein the breaker walls are attached to the pair of opposite-facing walls at a midpoint of the opposite-facing walls.

14. An ice container, comprising:

an ice container comprising a pair of opposite-facing walls and a bottom wall, disposed within a cabinet and located adjacent an ice maker; and a stir assembly positioned within the ice container, comprising a stir stick, a cam rod, and a pair of breaker walls; wherein the stir stick includes a bottom portion extending through the bottom wall and is configured to rotate about the bottom portion, the cam rod is coupled to the stir stick and is configured to accept a rotational motion input and deliver a linear motion output; and the pair of breaker walls are engaged with the cam rod near the bottom of the breaker walls, and hingedly attached to the pair of opposite-facing walls, and move between a first position and second position in relation to the rotational movement of the stir stick.

15. The ice container of claim 14, wherein the ice container is rectangular shaped.

16. The ice container of claim 14, wherein the stir stick comprises a rod.

17. The ice container of claim 16, wherein the stir stick is positioned at the center portion of the bottom wall.

18. The ice container of claim 14, wherein the breaker walls are attached to the pair of opposite-facing walls at a midpoint of the breaker walls.

19. The ice container of claim 14, wherein the breaker walls are attached to the pair of opposite-facing walls at a midpoint of the opposite-facing walls.

20. A method of breaking up ice within an ice container of a refrigerator, the method comprising:

providing an ice container including a first wall an opposing wall at a distance from the first wall and parallel with the first wall;

providing a stir stick operably connected to the ice container, the stir stick extending within the ice container and comprising a plurality of bends along its length;

providing a cam rod including a first end and a second end coupled with the stir stick;

providing a first breaker wall coupled with the first end of the cam rod and hingedly attached with the first wall, and a second breaker wall hingedly attached to the opposing wall and coupled with the second end of the cam rod;

rotating the stir stick within the ice container;

translating the cam rod along an axis normal to the first wall and second wall;

rocking the first breaker wall on the first wall between a first position and a second position; and rocking the second breaker wall on the second wall between a first position and a second position.

* * * * *